US006701582B1

(12) United States Patent
Milburn

(10) Patent No.: US 6,701,582 B1
(45) Date of Patent: Mar. 9, 2004

(54) TROUSER LEG RETAINING DEVICE

(76) Inventor: Vernon L. Milburn, 784 County Rd. 1508, Cullman, AL (US) 35058

( * ) Notice: Subject to any disclaimer, the term of this patent is extended or adjusted under 35 U.S.C. 154(b) by 0 days.

(21) Appl. No.: 10/369,463

(22) Filed: Feb. 20, 2003

(51) Int. Cl.[7] ..... A41F 17/04; A42B 7/00; A44B 21/00

(52) U.S. Cl. ..... 24/72.1; 24/300; 24/301; 24/302; 24/305; 24/298; 24/3.1; 2/312; 2/323

(58) Field of Search ..... 24/305, 300, 3.1, 24/3.13, 72.1, 72.5, 301, 302, 298; 2/309, 312, 323

(56) References Cited

U.S. PATENT DOCUMENTS 489,921 A * 1/1893 Billings ..... 24/301
1,153,334 A * 9/1915 Mansfield ..... 24/300
1,412,033 A * 4/1922 Oswald ..... 2/323
4,115,906 A * 9/1978 Lavine et al. ..... 24/72.1
4,941,213 A * 7/1990 Grilliot et al. ..... 2/312
5,542,156 A * 8/1996 Oglesby ..... 24/72.1
5,675,841 A * 10/1997 Jackson ..... 24/302
5,974,591 A * 11/1999 Leslie ..... 2/323

* cited by examiner

*Primary Examiner*—Victor Sakran

(57) ABSTRACT

This invention relates to a trouser leg retaining device which is used for maintaining one's trouser legs in the proper position in relation to one's shoes. This invention includes an elongated elastic strap with a snap fastener device at one end and either a locking clip or an O-ring at the opposite end. The snap fastens onto one's trouser leg while the O-ring fastens onto one's shoe. The elastic strap has an adjuster positioned on it to adjust the length of the strap.

19 Claims, 3 Drawing Sheets

TROUSER LEG RETAINING DEVICE

BACKGROUND OF THE INVENTION

1. Field of the Invention

The present invention relates to a trouser leg retaining device for use in connection with keeping one's trousers positioned in the proper place. The trouser leg retaining device has particular utility in connection with ensuring that the trouser leg does not get caught within the shoes.

2. Description of the Prior Art

Trouser leg retaining devices are desirable for keeping trouser legs in place and ensuring that the trouser leg does not get caught within the shoes.

The use of a footwear securing device is known in the prior art. For example, U.S. Pat. No. 5,974,591 to Leslie discloses a firefighter's boot to trouser strap device for keeping a firefighter's uniform together. However, the Leslie '591 patent does not have an elastomeric band which stretches with the movement of the user, and has further drawbacks of being unable to be used with any footwear other than boots.

U.S. Pat. No. 4,115,906 to Lavine et al discloses a clippable trouser retaining strap that maintains the cuff of a leg of a pair of trousers in a downward position. However, the Lavine et al '906 patent does not have a mechanism to secure the pant to the back of the shoe, and additionally does not have a design snap onto which a logo may be displayed.

Similarly, U.S. Pat. No. 4,941,213 to Grilliot et al discloses a firefighter's boot and trouser attachment that keeps a firefighter's boot attached to his trouser leg. However, the Grilliot et al '213 patent does not have an elastomeric strap, which stretches with the movement of the user, and cannot be used with any footwear other than boots. It has the additional deficiency of wrapping around the firefighters boot as opposed to attaching to the top of the boot.

Lastly, U.S. Pat. No. 5,542,156 to Oglesby discloses a trouser leg retaining device that keeps trouser legs attached to shoes to keep pant legs from riding up. However, the Oglesby '156 patent does not attach to the top of a shoe, and has the additional deficiency of attaching to the bottom of a shoe thus enabling the elastic strap to wear out quicker due to friction from walking on pavement.

While the above-described devices fulfill their respective, particular objectives and requirements, the aforementioned patents do not describe a trouser leg retaining device that allows attachment to the top of a shoe as opposed to wrapping around the side or the bottom of a shoe or boot. The present patent also can be used with any sort of footwear, not just boots as seen in some of the above-mentioned patents. Furthermore, the present patent utilizes an elastomeric strap to allow for stretching with the movement of the user. The snap used to attach the trouser to the shoe can be made with any design or logo for decoration. The present invention also can use either a circular hook device or an alligator clip for attachment to the shoe.

Therefore, a need exists for a new and improved trouser leg retaining device that can be used for keeping pants in place. In this regard, the present invention substantially fulfills this need. In this respect, the trouser leg retaining device according to the present invention substantially departs from the conventional concepts and designs of the prior art, and in doing so provides an apparatus primarily developed for the purpose of keeping pants legs in place.

SUMMARY OF THE INVENTION

In view of the foregoing disadvantages inherent in the known types of footwear securing device now present in the prior art, the present invention provides an improved trouser leg retaining device, and overcomes the above-mentioned disadvantages and drawbacks of the prior art. As such, the general purpose of the present invention, which will be described subsequently in greater detail, is to provide a new and improved trouser leg retaining device and method which has all the advantages of the prior art mentioned heretofore and many novel features that result in a trouser leg retaining device which is not anticipated, rendered obvious, suggested, or even implied by the prior art, either alone or in any combination thereof.

To attain this, the present invention essentially comprises an elastic band with opposing ends having a bell-shaped ring on one end and an O-ring on the other end. A rigid support member having a U-shaped channel on one end lies adjacent to the elastic band. The U-shaped channel has a shorter side with gripping teeth on the inside surface to grip the outside of the pant leg. A snap fastener device comprised of two separate sections is used to attach the elastic band and the support member to a pant leg. A first section of a snap goes through the bell-shaped ring and through a hole that is in the end of the support member that is opposite the U-shaped channel to connect the support member to the elastic band. The second section of the snap is pushed through the pant leg from the exterior of the pant leg to the interior of the pant leg to slidably engage with the first section of the snap to connect the trouser leg retaining device to the pant leg. The outside surface of the second section of the snap can be imprinted with a predetermined logo or design. The O-shaped ring has a coupling that opens to attach the trouser leg retaining device to a shoe strap on the back of a shoe. The ring is attached to the shoe and the snap attaches to the pant leg to keep the pant leg in place and not let it fall behind the shoe. The strap also has an adjuster secured to it to adjust the length of the elastic band.

There has thus been outlined, rather broadly, the more important features of the invention in order that the detailed description thereof that follows may be better understood and in order that the present contribution to the art may be better appreciated.

The invention may also include a locking clip at the bottom end of the elastic band as opposed to an O-shaped ring. The locking clip is useful if the shoes being worn do not have a hanging loop on their backside. The locking clip would have a pair of jaws pivotally attached by a spring with a pair of flanges. When pressure was applied to the flanges, the jaws would open to attach to the shoe. The locking clip would attach to the back of a shoe and could be used with any type of shoe. There are, of course, additional features of the invention that will be described hereinafter and which will form the subject matter of the claims attached.

Numerous objects, features and advantages of the present invention will be readily apparent to those of ordinary skill in the art upon a reading of the following detailed description of presently preferred, but nonetheless illustrative, embodiments of the present invention when taken in conjunction with the accompanying drawings. In this respect, before explaining the current embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of descriptions and should not be regarded as limiting.

As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

It is therefore an object of the present invention to provide a new and improved trouser leg retaining device that has all of the advantages of the prior art shoe to trouser strap device and none of the disadvantages.

It is another object of the present invention to provide a new and improved trouser leg retaining device that may be easily and efficiently manufactured and marketed.

An even further object of the present invention is to provide a new and improved trouser leg retaining device that has a low cost of manufacture with regard to both materials and labor, and which accordingly is then susceptible of low prices of sale to the consuming public, thereby making such trouser leg retaining device economically available to the buying public.

Still another object of the present invention is to provide a new trouser leg retaining device that provides in the apparatuses and methods of the prior art some of the advantages thereof, while simultaneously overcoming some of the disadvantages normally associated therewith.

Even still another object of the present invention is to provide a trouser leg retaining device for keeping pant legs in place. This keeps pants from falling behind shoes and further discourages upward movement of pant legs when moving. The trouser leg retaining device can be used with any type of footwear. Furthermore, the present invention uses an elastomeric band, which stretches with the movements of the user. The trouser leg retaining device is also attached to the top of the shoe as opposed to wrapping around the bottom of the shoe thus limiting friction to the band caused by movement. The present invention also has an outside snap onto which a logo or design could be placed for ornamental value.

These together with other objects of the invention, along with the various features of novelty that characterize the invention, are pointed out with particularity in the claims annexed to and forming a part of this disclosure. For a better understanding of the invention, its operating advantages and the specific objects attained by its uses, reference should be had to the accompanying drawings and descriptive matter in which there is illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein.

The same reference numerals refer to the same parts throughout the various figures.

DESCRIPTION OF THE PREFERRED EMBODIMENT

Figure 1:
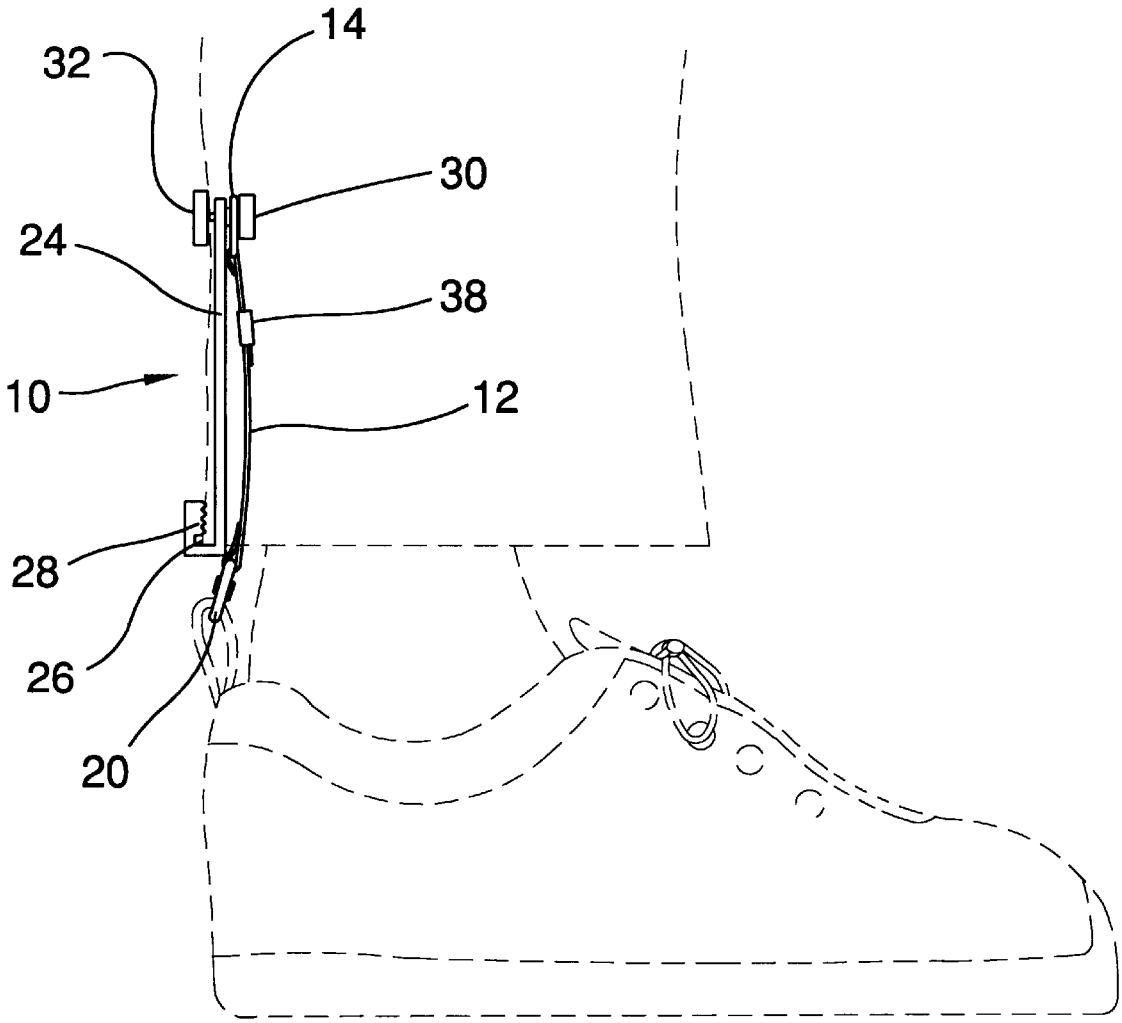
FIG. 1 is a right side view of the first embodiment of the trouser leg retaining device constructed in accordance with the principles of the present invention wherein the dashed lines are not part of the invention and represent the environment for the invention.

Referring now to the drawings, and particularly to FIGS. 1–4, a preferred embodiment of the trouser leg retaining device of the present invention is shown and generally designated by the reference numeral 10.

In FIG. 1, a new and improved trouser leg retaining device 10 of the present invention for keeping trouser legs in their proper place and ensuring that the trouser legs do not get caught within the shoes is illustrated and will be described. More particularly, the trouser leg retaining device 10 has an elastomeric band 12 with opposed end sections. One end section is attached to a bell-shaped ring 14 and is fastened to the interior of one's pant leg by a snap fastening device comprised of a first portion 30 and a second portion 32. The opposing end section is attached to an O-shaped ring 20 with a coupling 22 that can be opened or closed. The O-shaped ring 20 attaches to the shoe strap on the back of the shoe to fasten the elastomeric band 12 to the shoe. The elastomeric band 12 also has a locking clamp 38 secured to it to lengthen or shorten the band 12. A rigid support member 24 having a hole at one end and a U-shaped channel 26 at the opposing end lies adjacent to the elastomeric band 12. The U-shaped channel 26 has a shorter side having gripping teeth 28 along its interior surface to grip the hem of the pant leg. The trouser leg retaining device 10 is eight to ten inches long and an inch wide. In use, the trouser leg retaining device 10 is placed within the pant leg so that the rigid support member 24 lies adjacent to the interior of the pant leg. The hem of the pant leg is placed within the U-shaped channel 26 of the support member 24 so that the gripping teeth 28 grip the exterior surface of the pant leg. The first portion 30 of a snap fastener passes through the bell-shaped ring 14 on the elastic band 12 and then passes through the hole in the rigid support member 24. The second portion 32 of the snap fastener passes through the pant leg to attach to the first portion 30 of the snap fastener to hold the trouser leg retaining device 10 to the pant leg. The O-shaped ring 20 on the other end of the elastic band 12 is hooked through the shoe strap on the back of a shoe. The elastic band 12 is then adjusted to the desired length so that when sitting or standing, the elastic band 12 stretches and keeps the pant leg from falling into the shoe.

Figure 2:
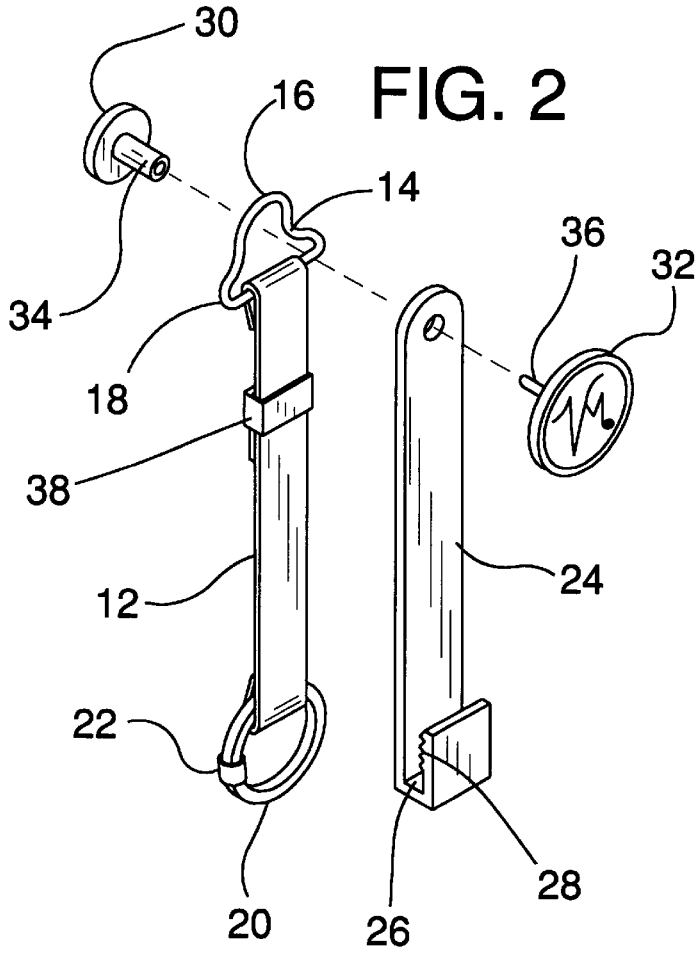
FIG. 2 is an exploded right perspective view of the first embodiment of the trouser leg retaining device of the present invention.

FIG. 2 shows how the parts of the trouser leg retaining device 10 fit together. The trouser leg retaining device 10 is comprised of an elongated elastomeric band 12, a rigid support member 24, and a fastener device that is comprised of a snap with two portions 30 & 32. The elastomeric band 12 has an O-shaped ring 20 attached to one end and a bell-shaped ring 14 attached to the other end. The O-shaped ring 20 has a coupling 22 that is used to open and close the O-shaped ring 20 for fastening the trouser leg retaining device 10 to the shoe strap on the back of a shoe. The bell-shaped ring 14 has a curved top portion 16 and a flat bottom portion 18. The elastomeric band 12 encircles the flat bottom portion 18 of the bell-shaped ring 14 to secure the bell-shaped ring 14 to the elastomeric band 12. The support member 24 has opposing top and bottom ends with a hole at its top end and a U-shaped channel 26 at its bottom end. The U-shaped channel 26 has a shorter side and a longer side with the shorter side having gripping teeth 28 placed along its inner surface. The support member 24 lies adjacent to the elastomeric band 12 and is connected to the elastomeric band 12 through the use of a snap 30 & 32. The snap is comprised of a first portion 30 and a second portion 32. The first portion 30 of the snap has an elongated receptacle 34 while the second portion 32 of the snap has a prong 36 that is slidably engageable with the elongated receptacle 34 on the first portion 30 of the snap. The receptacle 34 of the first portion 30 of the snap extends through the curved portion 16 of the bell-shaped ring 14 located at the top of the elastomeric band 12 and through the hole in the top of the support member 24 until it lies adjacent to the interior of the pant leg. The prong 36 of the second portion 32 of the snap passes through the pant leg to engage with the receptacle 34 of the first portion 30 of the snap to hold trouser leg retaining device 10 to the pant leg. In use, the support member 24 is placed adjacent to the inside surface of the pant leg so that the back hem of the pant leg inserts into the U-shaped channel 26 and is held in place by the gripping teeth 28. The elastomeric band 12 lies adjacent to the opposite side of the support member 24. The snap 30 & 32 is engaged to ensure that the trouser leg retaining device 10 stays in place on the pant. The O-shaped ring 20 is then secured to the shoe by opening the coupling 22 to allow for the trouser leg retaining device 10 to be secured to the shoe. Once the O-shaped ring 20 is hooked through the shoe strap, the coupling 22 is closed to ensure a secure attachment from the pant to the shoe. The outside surface of the second portion 32 of the snap could be imprinted with a predetermined logo or design.

Figure 3:
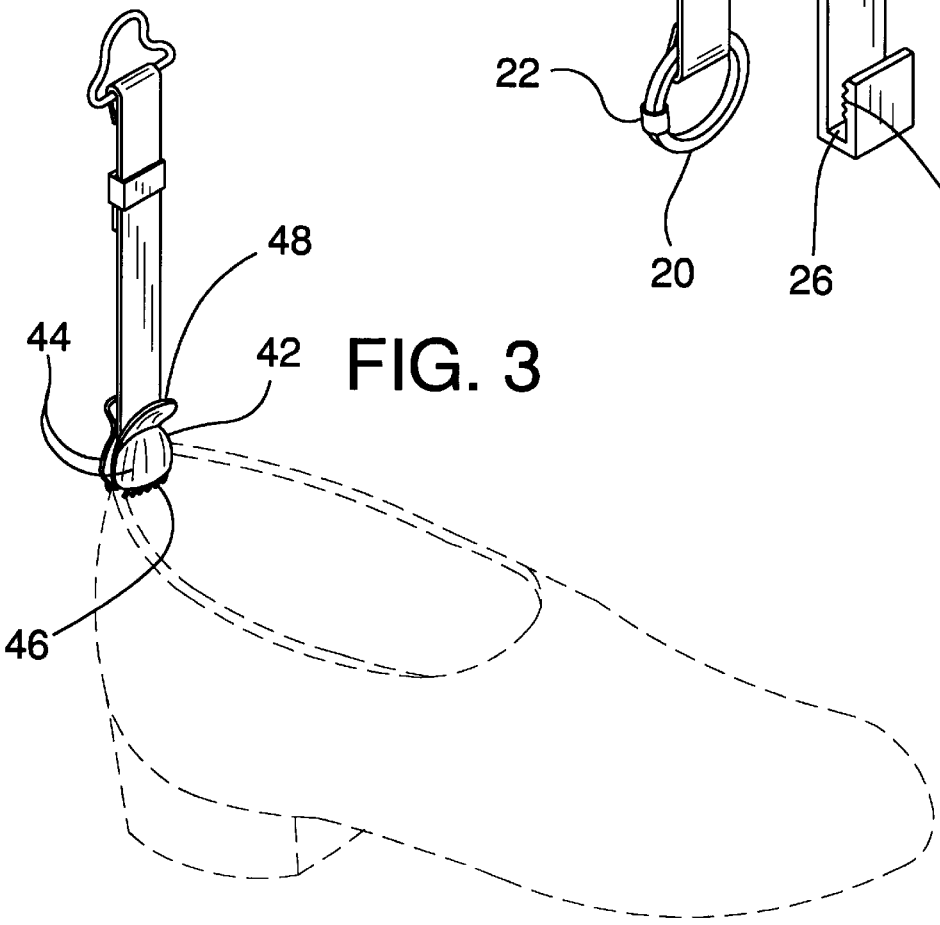
FIG. 3 is a right perspective view of the second embodiment of the trouser leg retaining device of the present invention.

FIG. 3 shows the second embodiment of the present invention, which utilizes a locking clip 42 for the attachment device as opposed to the O-shaped ring 20 of the first embodiment. The locking clip 42 has a pair of jaws 44 pivotally affixed to one another. Each of the jaws 44 has a plurality of teeth 46 affixed to one end. Each pair of jaws 44 has a flange 48 protruding from the end opposite the teeth 46. A spring (not shown) attaches the jaws 44 so that pressure applied to each flange 48 opens the jaws 44 to attach the trouser leg retaining device 10 to the back of a shoe.

Figure 4:
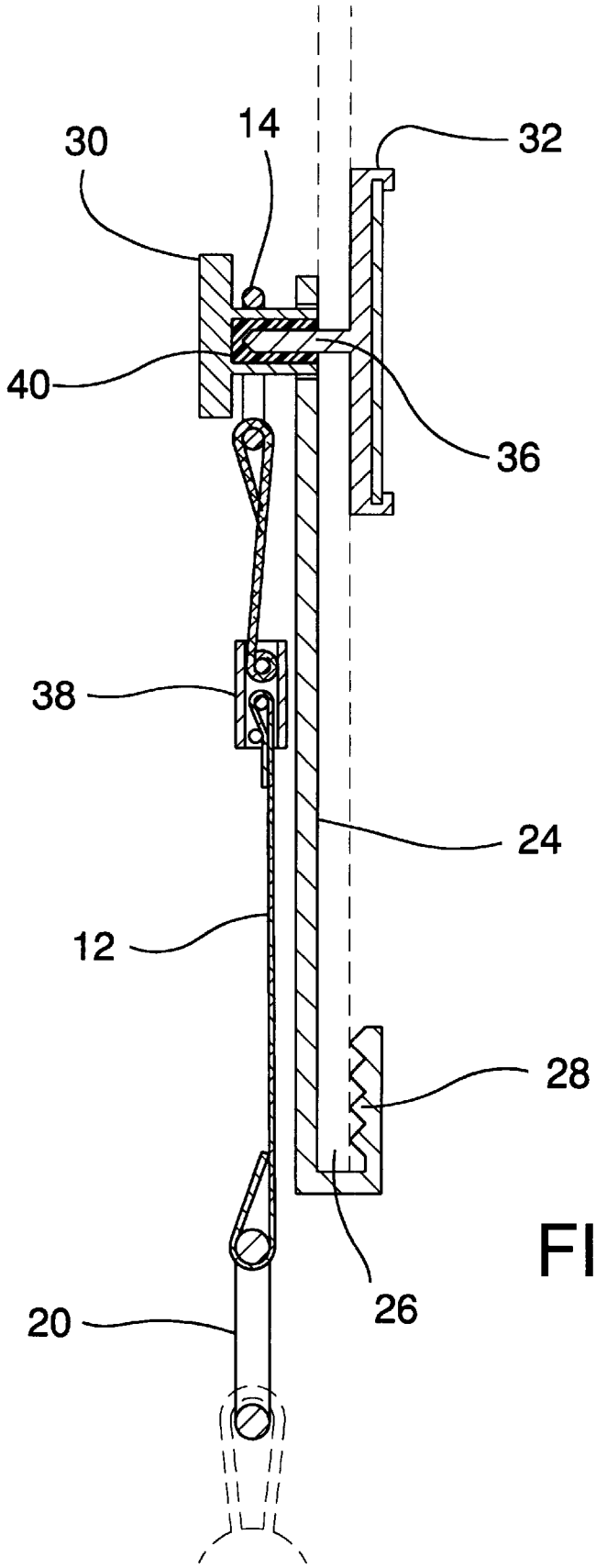
FIG. 4 is a cross-sectional view of the first embodiment of the trouser leg retaining device of the present invention.

FIG. 4 is a cross-sectional view of the trouser leg retaining device 10 engaged with the trouser leg. This figure shows the first portion 30 of the snap engaged with the second portion 32 of the snap to hold the supporting member 24 to the elastomeric band 12. The prong 36 of the second portion 32 of the snap passes through the exterior surface of the pant leg to slidably engage with the receptacle 34 of the first portion 30 of the snap. The receptacle 34 of the first snap portion is lined with a plastic holding material 40 that grips the prong 36 of the second snap portion 32 to hold the two snap portions 30 & 32 together. It also shows the snap 30 & 32 engagement with regard to placement on the trouser leg. The hem of the pant leg sits within the U-shaped channel 26 of the support member 24. The gripping teeth 28 of the U-shaped channel 26 hold the pant leg in place. The locking clamp 38 is shown as allowing the elastomeric band 12 to be lengthened or shortened as the need may be. In use, the trouser leg retaining device 10 is placed within the pant leg so that the rigid support member 24 lies adjacent to the interior of the pant leg. The hem of the pant leg is placed within the U-shaped channel 26 of the support member 24 so that the gripping teeth 28 grip the exterior surface of the pant leg. The receptacle 34 of the first portion 30 of a snap fastener passes through the bell-shaped ring 14 on the elastic band 12 and then passes through the hole in the rigid support member 24. The prong 36 of the second portion 32 of the snap fastener passes through the pant leg to attach to the receptacle 34 of the first portion 30 of the snap faster to hold the trouser leg retaining device 10 to the pant leg. The O-shaped ring 20 on the end of the elastic band 12 is hooked through the shoe strap on the back of a shoe. The elastic band 12 is then adjusted to the desired length using the locking clamp 38 so that when sitting or standing, the elastic band 12 stretches and keeps the pant leg from falling behind the shoe.

While a preferred embodiment of the trouser leg retaining device has been described in detail, it should be apparent that modifications and variations thereto are possible, all of which fall within the true spirit and scope of the invention. With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

I claim:

1. A trouser leg retaining device comprising:

an elongated elastomeric band of adjustable length having opposed top and bottom end sections;

a bell shaped ring having a flat portion and a curved portion wherein said top end section of said elastomeric band encircles said flat portion of said bell-shaped ring to secure said top end section of said elastomeric band to said bell-shaped ring;

a split O-shaped ring with a coupling wherein said bottom end section of said elastomeric band encircles said O-shaped ring to secure said bottom end section of said elastomeric band to said O-shaped ring;

an elongated support member having a top portion and a bottom portion, wherein said support member lies adjacent to and in a longitudinal direction with said elongated elastomeric band, and wherein said top portion of said elongated support member defines a hole therein and wherein said bottom portion terminates in a U-shaped channel;

a fastener means comprised of a snap, wherein said snap has a first portion and a second portion wherein said first portion of said snap has a flat section with an elongated receptacle extending therefrom and wherein said receptacle has an inside and an outside surface, and wherein said second portion of said snap has a flat section with a prong extending therefrom and wherein said elongated receptacle passes through said bell-shaped ring and through said hole in said support member to lie adjacent to the interior surface of the pant leg and wherein said second portion of said snap passes through said pant leg to slidably engage with said receptacle of said first portion of said snap;

a locking clamp for adjusting the length of said elastomeric band, wherein said locking clamp is fixedly secured to said elastomeric band.

2. The apparatus of claim 1, wherein said curved portion of said bell-shaped ring lies adjacent to said first portion of said snap that protrudes through said bell-shaped ring.

3. The apparatus of claim 1, wherein said U-shaped channel has a shorter side and a longer side with each of said sides having inside and outside surfaces.

4. The apparatus of claim 3, wherein said shorter side of said U-shaped channel contains a plurality of gripping teeth on said inside surface.

5. The apparatus of claim 1, wherein said inside surface of said receptacle of said first portion of said snap is lined with a plastic holding material.

6. The apparatus of claim 1, wherein the outside surface of said flat section of said second portion of said snap is imprinted with a predetermined logo or design.

7. The apparatus of claim 1, wherein said locking clamp is selectively clampable to said elastomeric band.

8. The apparatus of claim 1, wherein the positioning of said locking clamp on said elastomeric band adjusts the length of said elastomeric band.

9. An apparatus comprising:

an elongated elastomeric band of adjustable length having opposed top and bottom end sections;

a bell shaped ring having a flat portion and a curved portion wherein said top end section of said elastomeric band encircles said flat portion of said bell-shaped ring to secure said top end section of said elastomeric band to said bell-shaped ring;

a locking clip having a pair of jaws pivotally affixed to each other by a spring and wherein said locking clip is secured to said bottom end of said elastomeric band and wherein said clip engages the top back portion of a shoe;

an elongated support member having a top portion and a bottom portion, wherein said support member lies adjacent to and in a longitudinal direction with said elongated elastomeric band, and wherein said top portion of said elongated support member defines a hole therein and wherein said bottom portion terminates in a U-shaped channel;

a fastener means comprised of a snap, wherein said snap has a first portion and a second portion wherein said first portion of said snap has a flat section with an elongated receptacle extending therefrom and wherein said receptacle has an inside and an outside surface, and wherein said second portion of said snap has a flat section with a prong extending therefrom and wherein said elongated receptacle passes through said bell-shaped ring and through said hole in said support member to lie adjacent to the interior surface of the pant leg and wherein said second portion of said snap passes through said pant leg to slidably engage with said receptacle of said first portion of said snap a locking clamp for adjusting the length of said elastomeric band, wherein said locking clamp is fixedly secured to said elastomeric band.

10. The apparatus of claim 9, wherein said curved portion of said bell-shaped ring lies adjacent to said first portion of said snap that protrude through said bell-shaped ring.

11. The apparatus of claim 9, wherein each of said jaws has a plurality of teeth.

12. The apparatus of claim 9, wherein each of said jaws has a flange protruding therefrom and wherein said jaws open when pressure is applied to said flanges.

13. The apparatus of claim 9, wherein said U-shaped channel has a shorter side and a longer side with each of said sides having inside and outside surfaces.

14. The apparatus of claim 13, wherein said shorter side of said U-shaped channel contains a plurality of gripping teeth on said inside surface.

15. The apparatus of claim 9, wherein the inside surface of said receptacle of said first portion of said snap is lined with a plastic holding material.

16. The apparatus of claim 9, wherein the outside surface of said second portion of said snap is imprinted with a predetermined logo or design.

17. The apparatus of claim 9, wherein said locking clamp is selectively clampable to said elastomeric band.

18. The apparatus of claim 9, wherein the positioning of said locking clamp on said elastomeric band adjusts the length of said elastomeric band.

19. An apparatus comprised of:

an elongated elastomeric band of adjustable length having opposing top and bottom end sections;

a bell shaped ring having a flat portion and a curved portion wherein said top end section of said elastomeric band encircles said flat portion of said bell-shaped ring to secure said top end section of said elastomeric band to said bell-shaped ring and wherein said curved portion of said bell-shaped ring lies adjacent to said first section of said snap that protrudes through said bell-shaped ring;

a split O-shaped ring with a coupling wherein said bottom end section of said elastomeric band encircles said O-shaped ring to secure said bottom end section of said elastomeric band to said O-shaped ring;

an elongated support member having a top portion and a bottom portion, wherein said support member lies adjacent to and in a longitudinal direction with said elongated elastomeric band, and wherein said top portion of said elongated support member defines a hole therein and wherein said bottom portion terminates in a U-shaped channel having a shorter side and a longer side, each of said sides of said U-shaped channel having inside and outside surfaces, wherein said shorter side contains a plurality of gripping teeth on said inside surface;

a fastener means comprised of a snap, wherein said snap has a first portion and a second portion wherein said first portion of said snap has a flat section with an elongated receptacle extending therefrom wherein said receptacle has an inside surface and an outside surface wherein said inside surface of said receptacle of said first portion of said snap is lined with a plastic holding material and wherein said second portion of said snap has an outside surface and an inside surface whereby a prong extends from said inside surface and wherein said outside surface of said second portion of said snap is imprinted with a predetermined logo or design, and wherein said elongated receptacle passes through said bell-shaped ring and through said hole in said support member to lie adjacent to the interior surface of the pant leg and wherein said second portion of said snap passes through said pant leg to slidably engage with said receptacle of said first portion of said snap;

a locking clamp for adjusting the length of said elastomeric band, wherein said locking clamp is fixedly secured to said elastomeric band, said clamp being selectively clampable to said elastomeric band, the positioning of said clamp on said elastomeric band adjusting the length thereof.

* * * * *